United States Patent [19]

Ishii

[11] Patent Number: 4,727,363

[45] Date of Patent: Feb. 23, 1988

[54] VIDEO RAM WRITE CONTROL APPARATUS

[75] Inventor: Takatoshi Ishii, Oome, Japan

[73] Assignee: Tokyo Shibaura Denki Kabushiki Kaisha, Kawasaki, Japan

[21] Appl. No.: 913,605

[22] Filed: Sep. 29, 1986

Related U.S. Application Data

[63] Continuation of Ser. No. 530,077, Sep. 7, 1983, abandoned.

[30] Foreign Application Priority Data

| | | | |
|---|---|---|---|
| Sep. 20, 1982 | [JP] | Japan | 57-163422 |
| Sep. 20, 1982 | [JP] | Japan | 57-163425 |
| Sep. 20, 1982 | [JP] | Japan | 57-163426 |

[51] Int. Cl.[4] ..... G09G 1/00

[52] U.S. Cl. ..... 340/724; 340/726; 340/789; 340/798

[58] Field of Search ..... 340/724, 726, 727, 789, 340/798, 799

[56] References Cited

U.S. PATENT DOCUMENTS

| | | | |
|---|---|---|---|
| 4,016,544 | 4/1977 | Morita et al. | 340/747 |
| 4,280,186 | 7/1981 | Hidai et al. | 340/747 |
| 4,296,475 | 10/1981 | Nederlof et al. | 365/49 |
| 4,386,773 | 6/1983 | Bronstein | 340/799 |
| 4,424,572 | 1/1984 | Lorig et al. | 340/798 |
| 4,462,028 | 7/1984 | Ryan et al. | 340/799 |
| 4,491,836 | 1/1985 | Collmeyer et al. | 340/750 |

*Primary Examiner*—Gerald L. Brigance
*Assistant Examiner*—Jeffery A. Brier
*Attorney, Agent, or Firm*—Kenyon & Kenyon

[57] ABSTRACT

A video RAM write control apparatus comprises a video RAM of byte access for storing dot pattern data, and a write circuit for supplying write data of one byte and a write enable signal to the video RAM. The video RAM includes n (n being an arbitrary natural number) memory blocks, each consisting of 1 bit×N addresses, the same address being assigned to the n-bits word. The write circuit includes a bit mask register in which an n-bit bit mask pattern data having a flag in a specific bit is set, and NAND gates for supplying AND signals of an output of each bit of the bit mask register and a write enable signal to the write enable terminal of each memory block.

15 Claims, 13 Drawing Figures

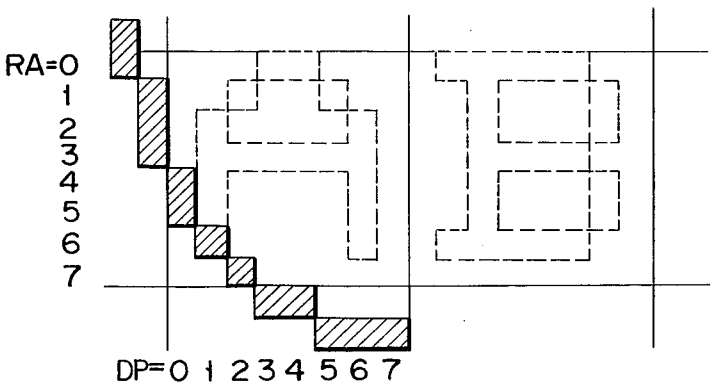
FIG. 8A
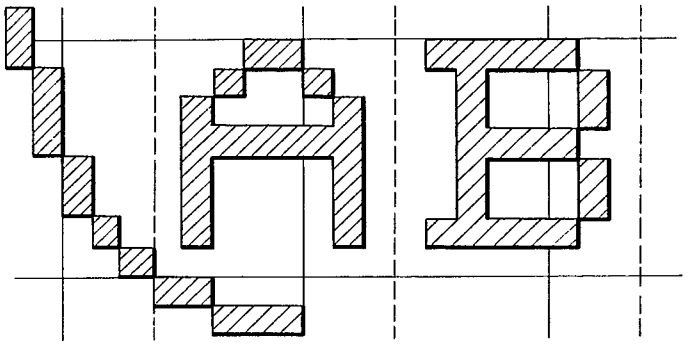
FIG. 8B
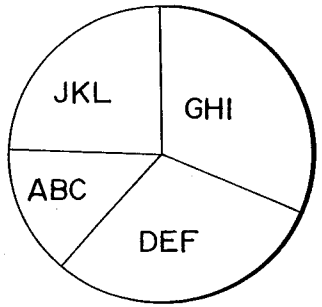
FIG. 7
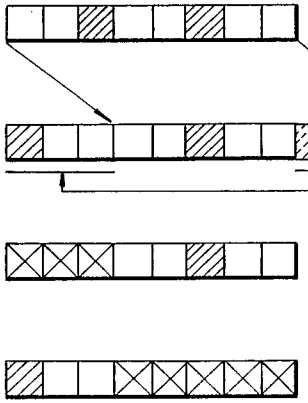
FIG. 9A
FIG. 9B
FIG. 9C
FIG. 9D

VIDEO RAM WRITE CONTROL APPARATUS

This is a continuation of co-pending application Ser. No. 530,077 filed on Sept. 7, 1983 now abandoned.

BACKGROUND OF THE INVENTION

This invention relates to a video RAM write control apparatus which is used for graphic display.

Generally, a video RAM including memories of the dynamic type is used to display characters and figures as dot patterns on a CRT display. The CRT display is directly connected to the video RAM and, by writing the dot pattern data into the video RAM, dot patterns are displayed on the CRT display. In the case of graphic display, one-bit data in the video RAM generally corresponds to one dot information displayed on the CRT screen. If video RAM is so addressed that data is accessed on a bit unit basis, the dot pattern data will easily be written into the video RAM. However, the addressing space of the video RAM becomes very large. Moreover, the video RAM must be comprised of memories from which data is read at high speed, since the timing at which one-bit data is read from the video RAM must be synchronized with the display of one dot on the CRT screen. Furthermore, a complicated driving circuit must be provided for the video RAM. Therefore, in general, several-bit data for several dots is stored in the video RAM at the corresponding address. For example, one-byte data for eight dots which are horizontally sequential on the CRT screen is stored at the corresponding address of the video RAM in which every word consists of 8-bits. The video RAM is accessed on a word unit basis so that the word readout from it is converted to serial data until the next word is accessed. A conventional video RAM write control method by which the video RAM is accessed on a word unit basis may be described as follows. By definition, the CRT screen consists of 256 dots in the vertical (Y) direction and 256 dots in the horizontal (X) direction and a dot on the screen is expressed by a location coordinate (X, Y).

The case wherein the dot at the location coordinate (100, 90) is lit up will be described. A memory capacity of $256 \times 256 = 65{,}536$ bits is required for the video RAM to store all of the dots on the screen by making one dot correspond with one bit. The video RAM stores 8-bit pattern data corresponding to 8 dots sequential in X direction as one word. Since the memory is accessed on a one byte (8 bits) unit basis, the physical addressing spaces of the video RAM are 8,192 ($=65{,}536 \div 8$). Therefore, an address signal of the video RAM requires 13 bits. In this example, 8-bit display data including dot pattern data at a location coordinate (100, 90) is stored in "0101101001100" address of the video RAM. The upper eight bits of that memory address are 8-bit binary numbers indicating the vertical location Y (=90) of the dot. The lower five bits are upper five bits of the 8-bit binary numbers representing the horizontal location X (=100). The pattern data "00001000" may be written into the video RAM at the memory address "0101101001100". This pattern data is produced by allotting data "1" to the fifth bit from the MSB according to the lower three bits of the 8-bit binary numbers representing the location coordinate Y (=90). The dot at the location of (100, 90) is lit up and displayed by this data writing. To display characters and figures by a set of dots, the data of each dot may be written into the video RAM by the above-mentioned method.

The data of eight dots which are continuous in the raster scanning direction, i.e. in the horizontal direction of the CRT is written into the video RAM at the corresponding address. Thus, in the case of drawing a straight line horizontally, or other similar cases, the adjacent dots are simultaneously displayed and the dot pattern data of both dots may have to be written at the common address. In this case, as described above, if the dot pattern data is merely written at the address obtained from the location coordinate, the dot pattern data which has previously been written at the address will be erased by the data that is later written at this address, so that the dots which are horizontally continuous cannot be displayed. Therefore, if it is necessary to write a plurality of dot pattern data at the common address in the video RAM, the dot pattern data which has already been written at the common address is once read out when new dot pattern data is written, the OR operation of this dot pattern data read out and the new data is executed, and its result is written. This could occur when new dots are further displayed horizontally within eight dots from the dot which has already been displayed, in addition to the case wherein the two adjacent dots are displayed.

Since this OR operation has been executed by a software, the conventional video RAM writing method causes the software to be under a heavy burden and a high-speed operation is impossible.

Moreover, in the display unit controlled by a video RAM, if one desires to increase the number of display dots on the screen and to elevate a resolution, the capacity of the video RAM as well as the amount of data to be processed will increase, so that this may inconveniently invite reduction of the display speed.

Furthermore, although the display locations of character patterns have been predetermined, it is desired that the character locations be changed, i.e., that the character locations be shifted by several dots. The software amount is excessively increased and, therefore, the processing speed is reduced against such a complicated pattern processing that the character locations are shifted by several dots. As described above, the conventional video RAM writing method greatly depends upon the software and cannot cope with complicated processings to write data into the RAM at a high speed.

SUMMARY OF THE INVENTION

It is an object of the present invention to provide a video RAM write control apparatus which can perform the complicated display control at a high speed by simplifying the software processing when the display data is written into the video RAM.

This object is realized by a video RAM write control apparatus comprising a video RAM including n (n: arbitrary natural number) memories each consisting of 1 bit$\times$N addresses (N: arbitrary natural number) and for storing dot pattern data, a storing circuit for storing an n-bit bit mask pattern data having a flag set in a specific bit, and a write circuit which supplies an n-bit write data to the video RAM and supplies a write enable signal to those memories which are specified by an output bit mask pattern data from the storing circuit.

According to the present invention, in the video RAM of which a plurality of bits are simultaneously accessed, the access control can be done on a bit unit basis, thereby enabling high-speed video RAM write processing.

BRIEF DESCRIPTION OF THE DRAWINGS

FIG. 7 is a pie chart, which is shown as an example of a display according to the second embodiment;

FIGS. 8A and 8B are enlarged views of portions of the above pie chart; and

FIGS. 9A to 9D are diagrams showing the write data pattern, to explain the bit shift processing operation.

DETAILED DESCRIPTION OF THE PREFERRED EMBODIMENTS

Figure 1:
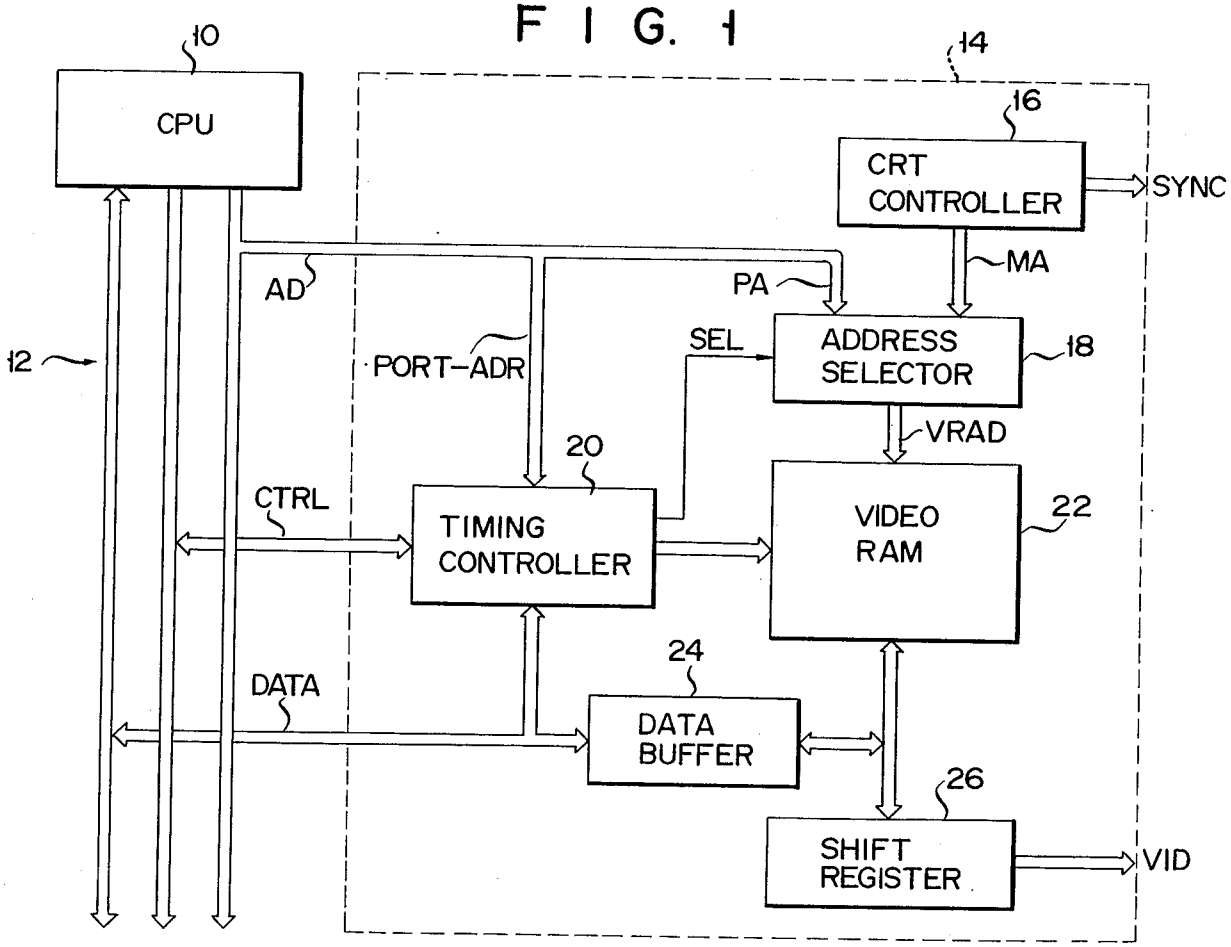
FIG. 1 is a block diagram of the entire display system, including an embodiment of a video RAM write control apparatus according to the present invention.

An embodiment of a video RAM write control apparatus according to the present invention will now be described with reference to the drawings. FIG. 1 shows a block diagram of a display control system using a video RAM according to this embodiment. The entire control system is controlled by a central processing unit (hereinafter, referred to as a CPU) 10. A display control circuit 14 is connected to the CPU 10 through a system bus 12 including an address bus (AD), data bus (DATA) and control bus (CTRL). The display control circuit 14 comprises a CRT controller 16, an address selector 18, a timing controller 20, a video RAM 22, a data buffer 24 and a shift register 26. The CRT controller 16 reads out data from the video RAM 22 and supplies to a CRT display (not shown), thereby executing the display of the dot pattern. The CRT controller 16 supplies a synchronizing signal SYNC to the CRT display and a memory address MA, which will be a read address of the video RAM 22, to one input terminal of the address selector 18. The address selector 18 receives the memory address MA supplied from the CRT controller 16 and a processor address PA as a write address supplied from the CPU 10, selecting either of them in accordance with a selection signal SEL from the timing controller 20, and then supplies the selected address as VRAM address data VRAD to the video RAM 22. The video RAM 22 is a semiconductor memory of the dynamic type which stores the dot pattern data of one screen of the CRT display, wherein one display dot is represented by one-bit data. It is now assumed that the screen of the CRT display consists of 640 dots×200 rows and the number of bits of one word is eight bits, and that the whole memory capacity of the video RAM 22 is 16 Kb (kilobytes) (8 bits×16K addresses). The video RAM 22 is constituted by eight memory blocks of 16 Kb (1 bit×16K addresses). The timing controller 20 performs the timing control of access of the video RAM 22 in accordance with various signals to be sent from the CPU 10, and this is an essential part of the present invention and will be described in detail later. The data buffer 24 is connected to the data bus and the video RAM 22 and temporarily stores read/write data of the video RAM 22. The shift register 26 is connected to the data buffer 24. The data which is read from the video RAM 22 is output as a video signal VID from the shift register 26 by bit serial.

Figure 2:
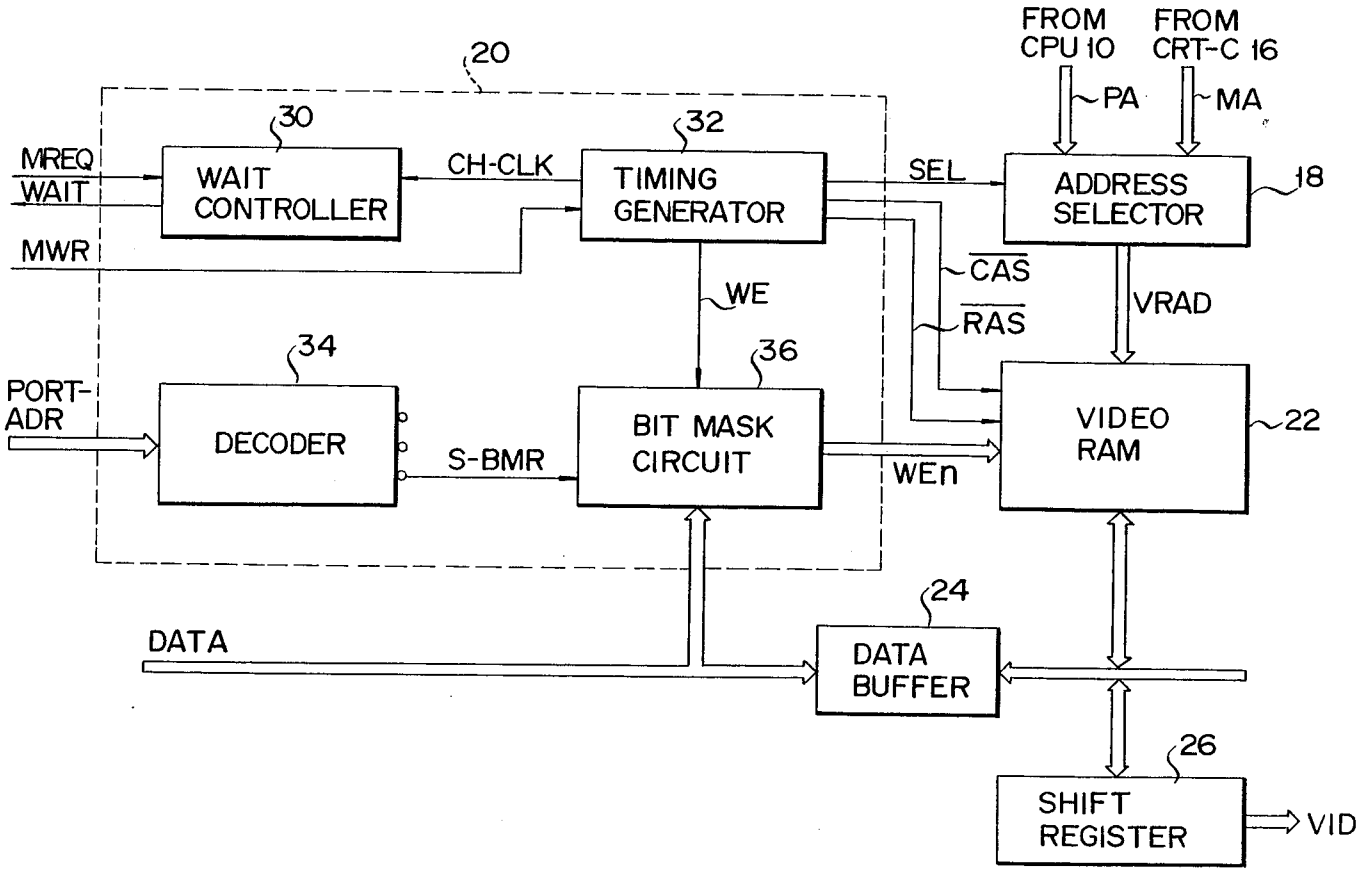
FIG. 2 is a block diagram of one embodiment of the video RAM write control apparatus.

FIG. 2 shows a detailed block diagram of the timing controller 20, which is a write control apparatus according to the present invention. The timing controller 20 comprises a wait controller 30, a timing generator 32, a decoder 34 and a bit mask circuit 36. The wait controller 30 controls the accesses of the video RAM 22 by the CPU 10 and by the CRT controller 16. Namely, the address selector 18 selects the CRT controller 16 unless otherwise requested by the CPU 10. When a memory request signal MREQ is supplied from the CPU 10 to the wait controller 30, the wait controller 30 sends a wait signal WAIT to the CPU 10 until access of the video RAM 22 by the CPU 10 is enabled, i.e., until the present memory access is finished and no character clock CH-CLK is supplied from the timing generator 32. After the CPU 10 has sent the memory request signal MREQ, when it receives no wait signal WAIT, the CPU 10 sends a memory write request signal MWR to the timing generator 32. The timing generator 32 then supplies the SEL signal for selecting the CPU 10 to the address selector 18, in response to this MWR signal. The timing generator 32 supplies a column address selection signal $\overline{CAS}$ and a row address selection signal $\overline{RAS}$ to the video RAM 22, and supplies a write enable signal WE to the bit mask circuit 36, in accordance with the MWR signal. The bit mask circuit 36 has a bit mask register to store 8-bit bit mask pattern data, as will be described later. The decoder 34 receives a port address PORT-ADR from the CPU 10 and decodes this, then supplies a bit mask register strobe signal S-BMR to the bit mask circuit 36. The bit mask circuit 36 selectively supplies a write enable signal $\overline{WEi}$ to the memory block in the video RAM 22, in accordance with the 8-bit bit mask pattern data. Namely, the write control of data is performed on the memory block unit basis.

Figure 3:
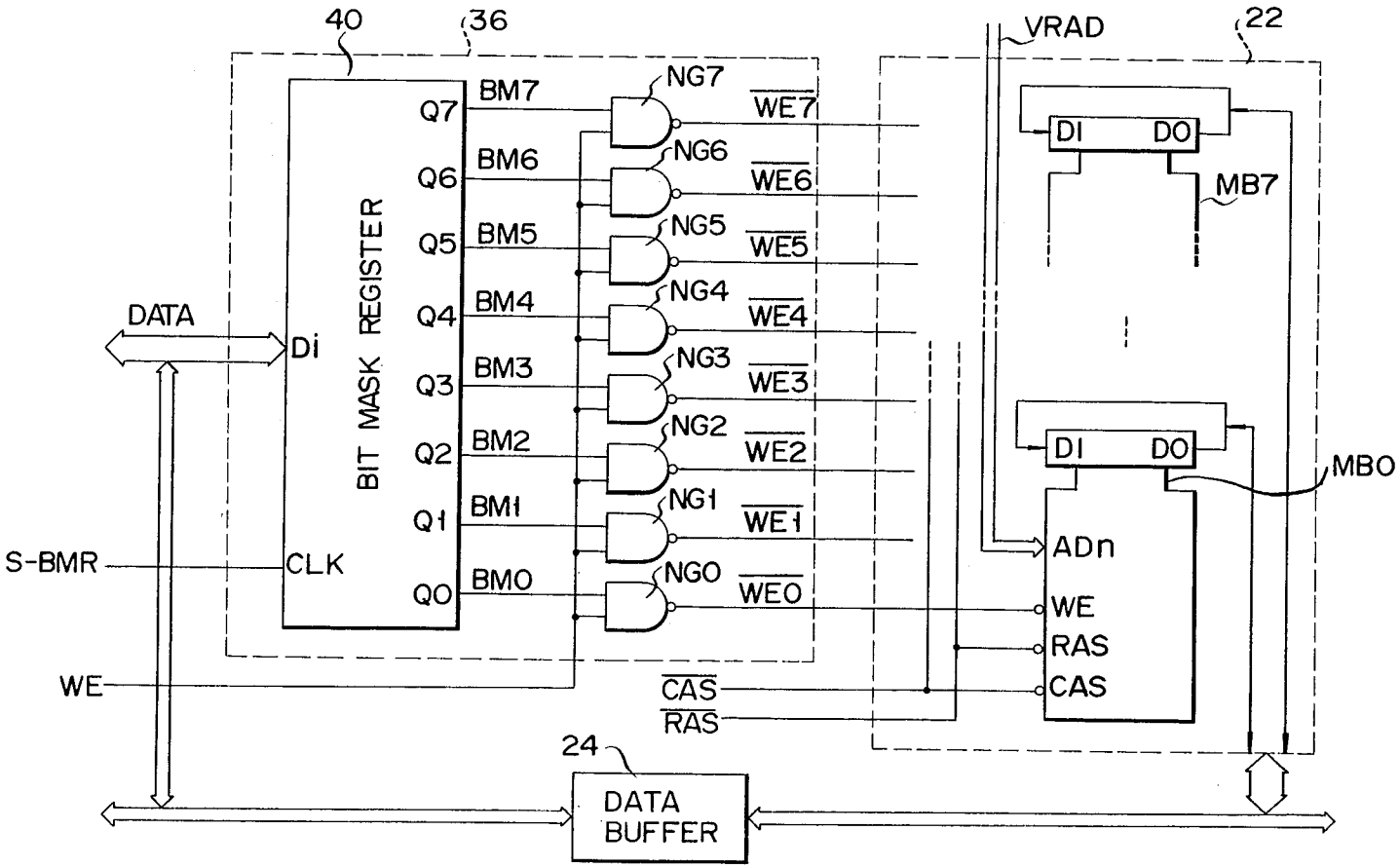
FIG. 3 is a detailed block diagram of a bit mask circuit in FIG. 2.

FIG. 3 shows a detail of the bit mask circuit 36. The bit mask circuit 36 comprises an 8-bit bit mask register 40 and eight NAND gates NG0, NG1, . . . , NG7 wherein output signals BM0, BM1, . . . , BM7 of each bit of the bit mask register 40 are respectively supplied to each one input terminal. A data bus DATA is coupled to a data input terminal Di (i=0, 1, . . . , 7) of the register 40, and the S-BMR signal is supplied from the decoder 34 to a clock terminal CLK of the register 40. A WE signal is supplied from the timing generator 32 to the other input terminals of the NAND gates NG0, NG1, . . . , NG7. Write enable signals $\overline{WE0}$, . . . , $\overline{WE7}$ from the NAND gates NG0, . . . , NG7 are respectively supplied to each write enable terminal WE of memory blocks (16 Kb DRAM) MB0, . . . , MB7 in the video RAM 22. The $\overline{CAS}$ and $\overline{RAS}$ signals from the timing generator 32 are supplied to each column address selecting terminal CAS and each row address selecting terminal RAS of the memory blocks MB0, . . . , MB7. The VRAD address signal is supplied from the address selector 18 to each address terminal ADn of the memory blocks MB0, . . . , MB7.

The operation of this embodiment may be described as follows. In this embodiment, the video RAM is selectively accessed by either the CPU 10 or the CRT controller 16. During a period of time when the ordinary refresh, i.e., display of the CRT screen is performed the address selector 18 selects the memory address MA from the CRT controller 16. The output address VRAD (MA herein) of the selector 18 is supplied to each address terminal ADi of the memory blocks MB0, . . . , MB7, so that the display dot pattern data in the video RAM 22 is read out 8 bits at a time. The 8-bit parallel read data is converted to serial data by the shift register 26, and is sent as a 1-bit serial video signal VID to the CRT display. The data is read from the video RAM 22 by the CRT controller 16, so that the video RAM 22 and the CRT screen are refreshed.

The writing operation of the display dot pattern data into the video RAM 22 may be described as follows. This operation is started when a bit mask pattern data, as will described later, is stored into the bit mask register 40 provided in the bit mask circuit 36. A certain input/output port address of the CPU 10 is assigned to the bit mask register 40. When the CPU 10 executes an output command (OUT PORTADDRESS, DATA), the bit mask register strobe signal S-BMR is supplied to the bit mask register 40 and an arbitrary 8-bit bit mask pattern data is written into the register 40. In the bit mask pattern data, data "1" is allotted to the bit corresponding to the location in which a dot is displayed. The CPU 10 supplies the memory request signal MREQ to the wait controller 30. When the CPU 10 becomes accessible, the wait controller 30 stops generating wait signal. When the wait controller 30 stops generating the wait signal, the CPU 10 supplies a memory write request signal MWR to the timing generator 32. The timing generator 32 changes the selection signal SEL. The selector 18 selects the processor address PA from the CPU 10 in response to the change of selection signal SEL. The processor address PA is calculated from the location coordinate (X, Y) at which a dot is displayed by the method described in the "Background of the Invention". The CPU 10 generates calculated processor address and memory write data. The memory write data is an 8-bit data of all "1" when the dot is displayed and of all "90" when the dot is not displayed at the location specified by the processor address PA. The write data is written into the data buffer 24. The timing generator 32 supplies the $\overline{CAS}$, $\overline{RAS}$ signals to the video RAM 22 and supplies the WE signal to the bit mask circuit 36 at the respective timings.

The write enable signal WE from the timing generator 32 is converted into write enable signals $\overline{WE0}$, . . . , $\overline{WE7}$ to the memory blocks MB0, . . . , MB7 through the NAND gates NG0, . . . , NG7 to which the bit mask data is also supplied, so that only the memory block corresponding to the bit of "1" of the bit mask pattern data is write-enabled. Hence, the video RAM 22 is enabled to selectively write data into arbitrary bit(s) among eight bits.

By way of illustration, the case wherein the dot pattern (data "1") is only written in bit 3 (the fourth bit) in an address (8 bots on the CRT screen) in the video RAM 22 will be described. In such a case, the bit mask pattern data may be "00010000", i.e., only the fourth bit would be "1" and the remaining bits would be "0". Data "11111111" is provided as write data to the video RAM 22. Only $\overline{WE3}$ becomes "0" by the bit mask pattern data and only the fourth bit memory block MB3 is write-enabled.

In the case of byte access, as in the prior art, the bit mask pattern data is all "1" and the write data may be the data corresponding to a desired display pattern. On the contrary, if one desires not to display bit 3, the bit mask pattern data is similarly "00010000" and the write data may be "00000000".

As described above, according to the present embodiment, in the video RAM of one-byte access, the write control is done on a bit unit basis. Therefore, in the case of writing dot pattern data many times at the common address, there is no need to execute the OR operation of the data which has been already written and new data that will be written, which allows the burden on the software to be lightened. Thus, the write processing can be carried out at a high speed.

Figure 4:
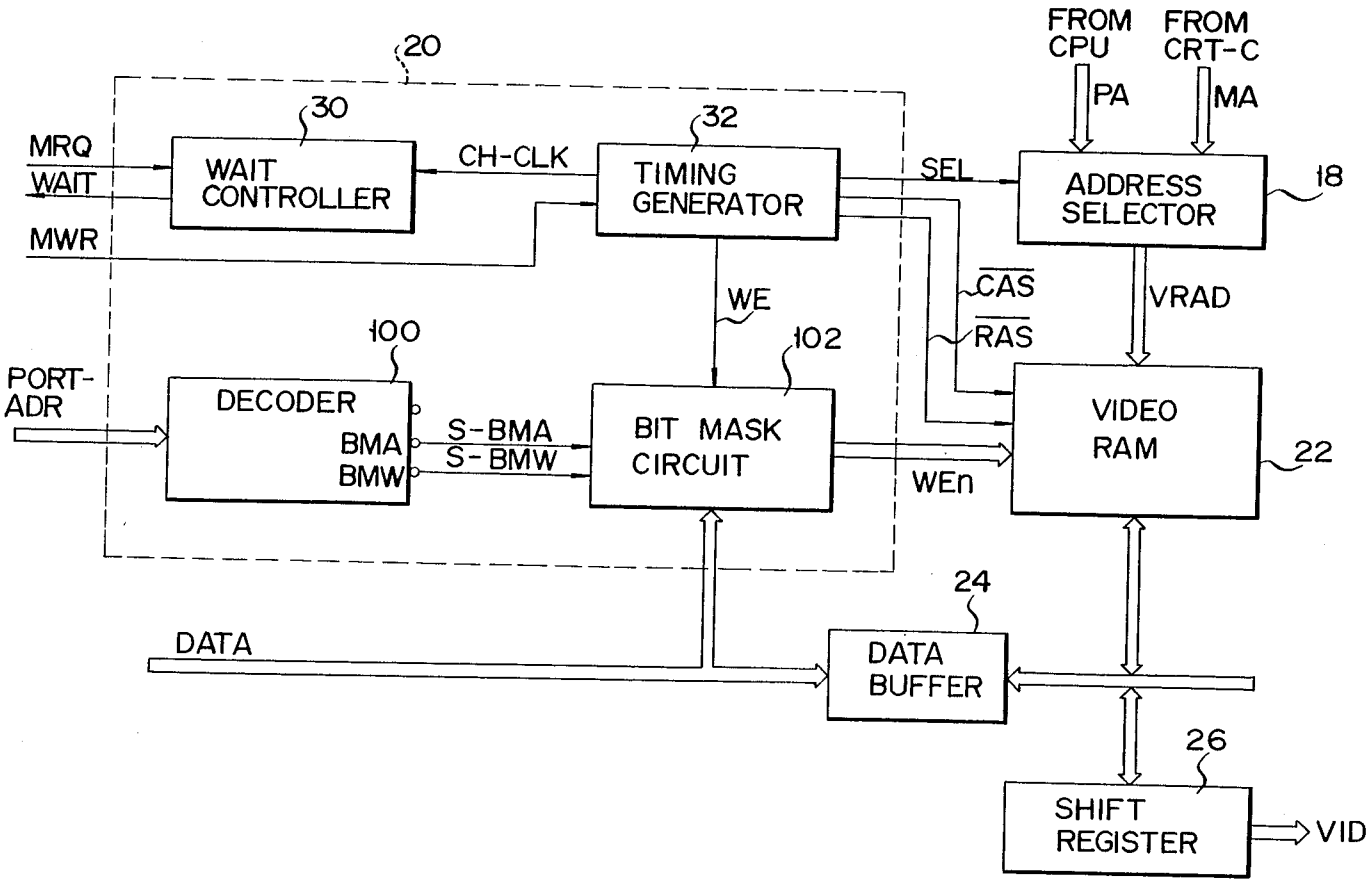
FIG. 4 is a block diagram in a second embodiment of the video RAM write control apparatus.

A second embodiment of the video RAM write control apparatus according to the present invention will be described. The second embodiment is substantially the same as the first embodiment except for the bit mask circuit configuration. Since the same parts and elements as those of the first embodiment are designated by the same reference numerals, they will not be described any further, for the sake of simplicity. The overall system is identical to the first embodiment shown in FIG. 1. FIG. 4 shows a detailed block diagram of the timing controller 20, which corresponds to FIG. 2 in the first embodiment. A decoder 100 supplies a write strobe signal S-BMW to a bit mask memory and a data set strobe signal S-BMA to a bit mask memory address register, both in a bit mask circuit 102.

Figure 5:
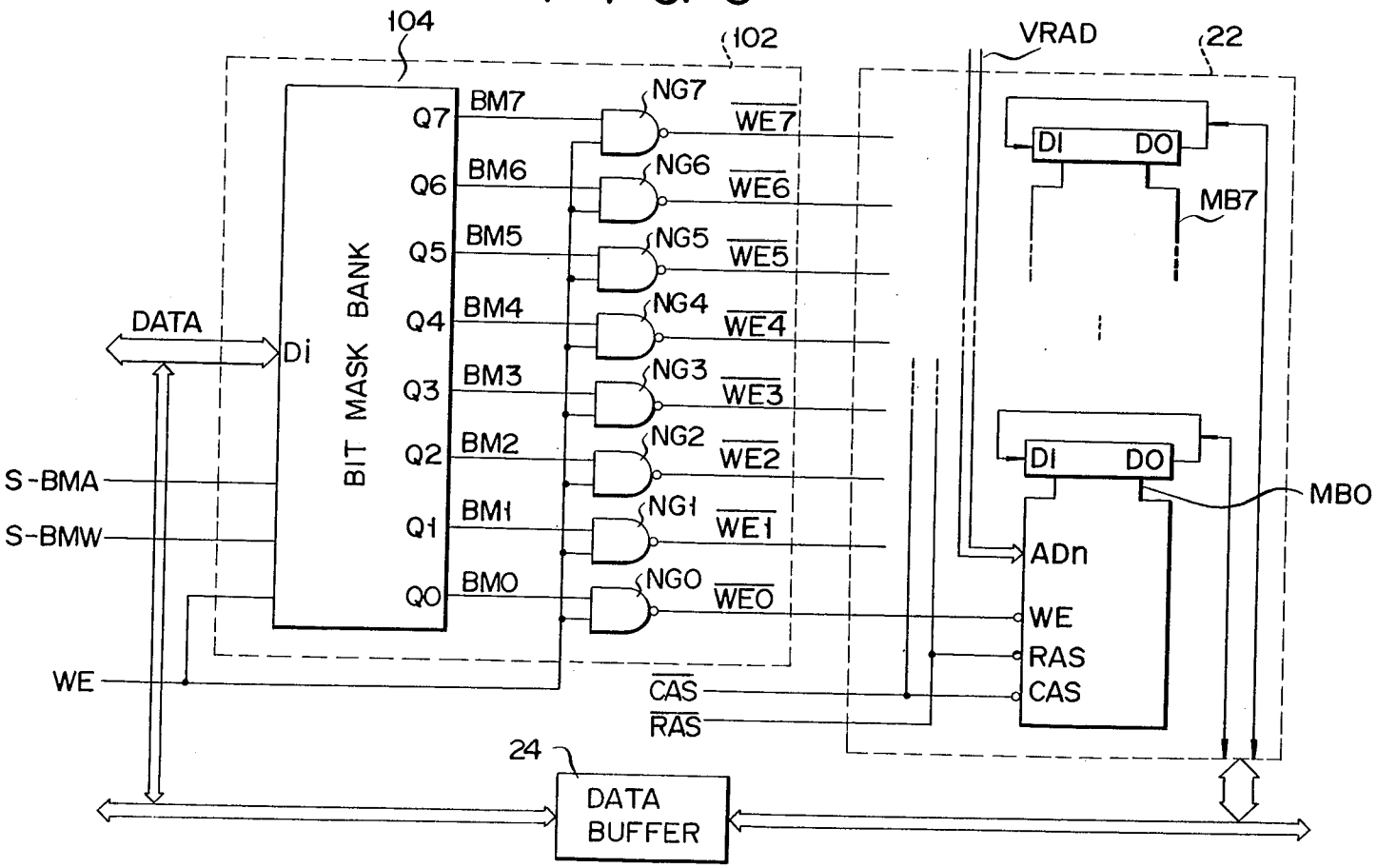
FIG. 5 is a detailed block diagram of a bit mask circuit of FIG. 4.
Figure 6:
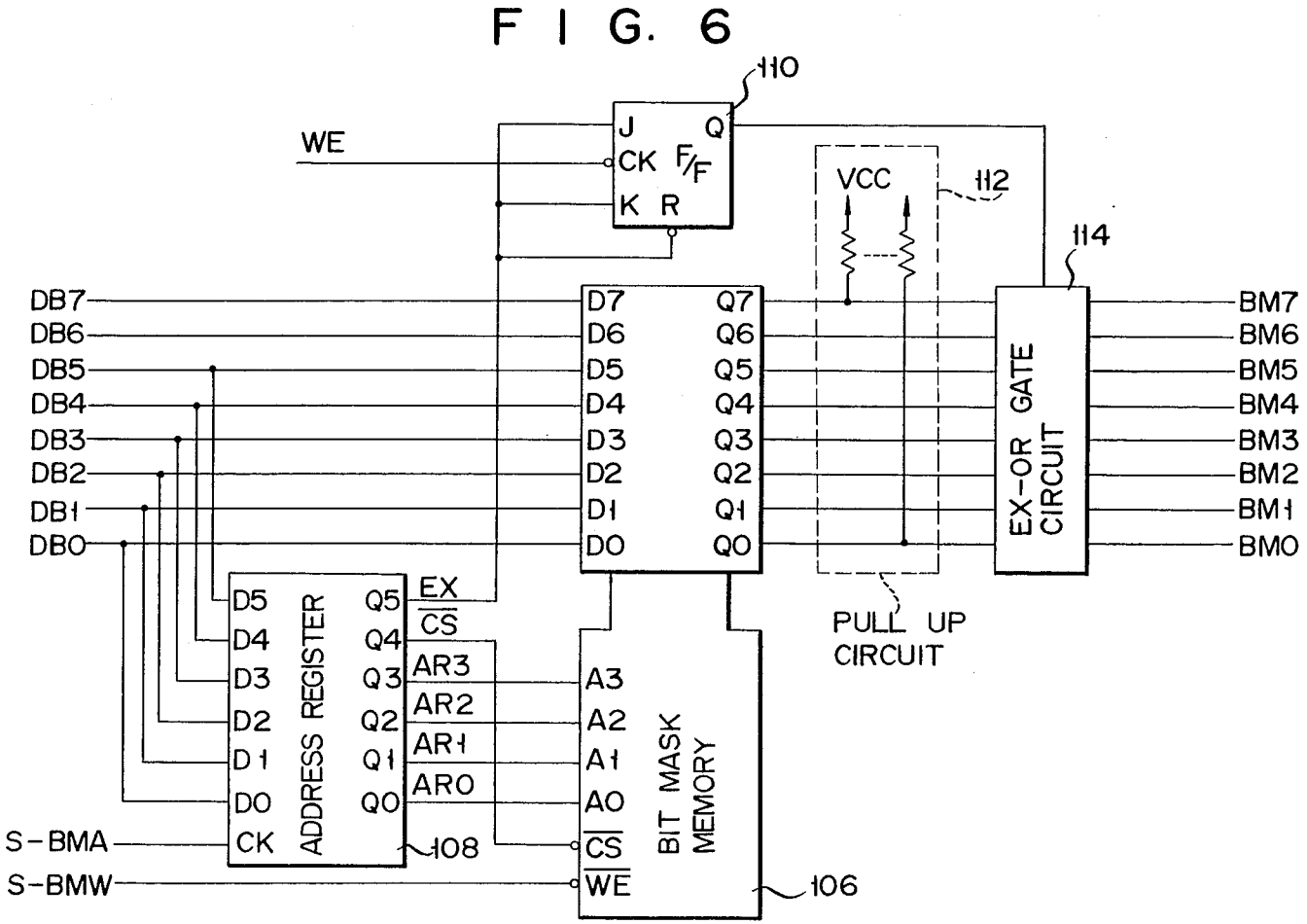
FIG. 6 is a detailed block diagram of a bit mask bank of FIG. 5.

FIG. 5 is a diagram showing a structure of the bit mask circuit 102. In this embodiment, the bit mask circuit 102 comprises a bit mask bank 104 in place of the bit mask register of the first embodiment, and NAND gates NG0, NG1, . . . , NG7. The bit mask bank 104 comprises as shown in FIG. 6, a bit mask memory 106, a bit mask memory address register 108, a JK flip-flop 110, a pull-up circuit 112 and an EX-OR gate circuit 114. The bit mask memory 106 is used to pre-store a various kinds of 8-bit bit mask pattern data. In this embodiment, the bit mask memory 106 is constituted by a 16-byte RAM and is able to pre-store 16 bit mask data. The address register 108 latches control signals and address signals of a total of six bits, consisting of 4-bit addresses AR0, AR1, AR2 and AR3, as well as each 1-bit bit mask memory selection signal $\overline{CS}$ and inversion control signal EX of the bit mask pattern data, upon reading or writing the bit mask pattern data in the bit mask memory 106. The lower five bits of the data bus are connected to data input terminals D1 to D5 of the address register 108. The data set strobe signal S-BMA is supplied from the decoder 100 to a clock terminal CK of the address register 108, and the write strobe signal S-BMW from the decoder 100 is supplied to the write enable terminal $\overline{WE}$ of the bit mask memory 106. The memory selection signal $\overline{CS}$ from the address register 108 is supplied to the chip selecting terminal $\overline{CS}$ of the bit mask memory 106. The data bus is connected to the data input terminals D0 to D7 of the bit mask memory 106, and its data output terminals Q0 to Q7 are connected through the pull-up circuit 112 to the EX-OR gate circuit 114. The EX-OR gate circuit 114 consists of eight EX-OR gates, and each of the output terminals of the bit mask memory 106 is connected to one input terminal of each EX-OR gate. The inversion control signal EX is supplied from the address register 108 to J and K input terminals and a reset terminal R of the JK flip-flop 110. The write enable signal WE from the timing generator 32 is supplied to a clock terminal CK of the JK flip-flop 110. An output signal from a Q output terminal of the JK flip-flop 110 is supplied to the other input terminal of each EX-OR gate in the EX-OR gate circuit 114. Output signals of the EX-OR gate circuit 114 are supplied to the NAND gates NGO, NG1, . . . , NG7 as output signals BM0, BM1, . . . , BM7 of the bit mask bank 104.

The operation of the second embodiment will be explained. The operation during the period of time when the dot patterns are displayed on the CRT screen is the same as that of the first embodiment; therefore, its description is omitted. The data writing operation to the video RAM 22 is now described. Even in this embodiment, although the video RAM 22 adopts the byte access method, it can write on the bit unit basis. In the case wherein the bit mask is not employed, i.e. in the case wherein the writing operation is done on the byte (8 bits) unit basis, the bit mask pattern data BM0, . . . , BM7 is all "1" in the first embodiment. However, in the second embodiment, bit mask pattern data "11111111" is not stored in the bit mask memory 106, in view of the relationship against other processings. Therefore, such a writing operation is carried out via the following method. Data "1" is set to bit 4 (Q4) of the address register 108 via data set by the CPU 10 and the bit mask memory selection signal $\overline{CS}$ becomes "1", ihibiting the access of the bit mask memory 106. The outputs of each bit of the bit mask memory 106 when it is not chip-selected are all "1" because they have been pulled up. The $\overline{Q}$ output of the flip-flop 110 is "0" since it has been reset at the initial time, so that the output of the bit mask memory 106 is not inverted by the EX-OR gate circuit 114 but output as it is. In this way, according to this embodiment, by inhibiting chip selection of the bit mask memory 106, the bit mask pattern data which is equivalently all "1" is output from the bit mask bank 104, so that all memory blocks MB0, . . . , MB7 are write-enabled.

The operation to perform the write control on the bit unit basis using the bit mask function will be described. In the initial stage, it is necessary to write predetermined 16-bit mask pattern data into the bit mask memory 106. In this embodiment, the bit mask data shown in the following table is written in the bit mask memory 106. The data at addresses 1 to 15 are specified, though the data at address 0 is not specified.

TABLE

| | DATA | | | | | | | |
|---|---|---|---|---|---|---|---|---|
| ADDRESS | 0 | 1 | 2 | 3 | 4 | 5 | 6 | 7 |
| 0 | X | X | X | X | X | X | X | X |
| 1 | 0 | 1 | 1 | 1 | 1 | 1 | 1 | 1 |
| 2 | 0 | 0 | 1 | 1 | 1 | 1 | 1 | 1 |
| 3 | 0 | 0 | 0 | 1 | 1 | 1 | 1 | 1 |
| 4 | 0 | 0 | 0 | 0 | 1 | 1 | 1 | 1 |
| 5 | 0 | 0 | 0 | 0 | 0 | 1 | 1 | 1 |
| 6 | 0 | 0 | 0 | 0 | 0 | 0 | 1 | 1 |
| 7 | 0 | 0 | 0 | 0 | 0 | 0 | 0 | 1 |
| 8 | 1 | 0 | 0 | 0 | 0 | 0 | 0 | 0 |
| 9 | 0 | 1 | 0 | 0 | 0 | 0 | 0 | 0 |
| 10 | 0 | 0 | 1 | 0 | 0 | 0 | 0 | 0 |
| 11 | 0 | 0 | 0 | 1 | 0 | 0 | 0 | 0 |
| 12 | 0 | 0 | 0 | 0 | 1 | 0 | 0 | 0 |
| 13 | 0 | 0 | 0 | 0 | 0 | 1 | 0 | 0 |
| 14 | 0 | 0 | 0 | 0 | 0 | 0 | 1 | 0 |
| 15 | 0 | 0 | 0 | 0 | 0 | 0 | 0 | 1 |

This is because, when it is necessary to use a bit mask pattern data which is not stored at addresses 1 to 15, address 0 is used to store such a data. The data in the addresses 1 to 7 represent the bit mask patterns to mask the upper bits for only the same bits as the address, i.e., to disable the write to the memory blocks, corresponding to the upper bits, and are used for a bit shift processing which will be described later. The data in the addresses 8 to 15 are the mask patterns to write to a predetermined one bit.

For the write of these bit mask pattern data, the CPU 10 first sets data "0" in bit 4 (Q4) of the address register 108, thereby enabling the access of the bit mask memory 106. Thereafter, addresses 0 to 15 are set in bits 0 to 3 of the address register 108, and the data in the above table is sequentially written through the data bus into the bit mask memory 106.

When data "1" is set in bit 5 (Q5) of the address register 108, the JK flip-flop 110 becomes operative and is set or reset in response to the write enable signal WE from the timing generator 32. Thus, the output of the JK flip-flop 110 is inverted with the timing at the trailing edge of the write enable pulse. When the output of the JK flip-flop 110 is "0", the EX-OR gate circuit 114 outputs the output data of the bit mask memory 106 as it is as previously described, and when the output of the JK flip-flop 110 is "1", it inverts the output of the bit mask memory and outputs. In other words, in this embodiment, although the bit mask memory 106 stores 16 bit mask pattern data, the number of the pattern data is substantially doubled due to inversional function of the EX-OR gate circuit 114.

The writing operation will now be described with respect to an example of the concrete pattern on the basis of the above explanation. For instance, the pie chart shown in FIG. 7 is considered here. The pie chart is drawn in such a manner that the circle pattern is first written, the segment lines dividing the circle into segments are written and, finally character data ABC etc. in each segment are written into the video RAM 22. The circle is written one dot at a time by calculating the location coordinate of the circumference. The CRT screen is here defined by the character positions, each of which consists of 8 dots×8 dots. Each character position has a raster address RA in the vertical direction and a dot position DP in the horizontal direction. The video RAM 22 is accessed for every raster address. The memory blocks MB0, . . . , MB7 correspond to the dot positions DP=7, . . . , 0 in each raster address, respectively. In the left character positions of FIG. 8A, it is now assumed that dot pattern data is written in the location where the raster address is 7 and the dot position is 2 (wherein, an origin of the coordinate locates at the upper left position in FIG. 8A). The x-y coordinates of the circumference are computed. These are divided respectively by 8 to obtain the quotients, thereby obtaining the x-y coordinates of character position. The dot position DP and the raster address RA are obtained respectively by the remainders of the division. To produce the bit mask pattern data for writing one bit, the CPU 10 executes the OR operation of 8 "001000" and DP=2 "10", thereby obtaining the 6-bit mask memory address of "001010". The lower 4 bits (=8 ) of 001000 indicate the address in the table shown previously at which the first bit mask pattern data used to write one bit has been stored. The upper 2 bits represent EX="0" (the bit mask pattern data being inhibited for inversion) and $\overline{CS}$="0" (the bit mask memory being made accessible). Data "001010" obtained as a result of the OR operation is set to the bit mask memory 106. This data set is carried out in such a manner that "XX001010" (X being unspecified) is output to the data bus and the S-BMA signal is decoded by the decoder 100. The bit mask pattern data "00100000" of address=10 (shown in the above table) is read out from the bit mask memory 106 and respectively supplied to the NAND gates NG7, . . . , NG0. Thus, only the memory block MB5 is write-enabled, and the CPU 10 merely provides the write data of all "1" in the data buffer 24, thereby allowing the dot to be displayed in the location coordinate of RA=7 and DP=2 at the left character position in FIG. 8A. In this way, the dots are sequentially written on the circumference, thereby writing the circular pattern. In the same manner, the segment lines are also written one dot at a time.

The operation to write the character data into the segment will be described. As shown in FIG. 8A, since the segment used to display ABC is so narrow to write the characters in compliance with the predetermined character positions, character "A" will have come into contact with a part of the circumference, which may be unsightly. In such a case, the characters must be slightly shifted away from the character positions. The vertical shift processing might then be easily performed by simply applying the processing with respect to the raster position to ordinary write processing.

The horizontal shift processing operation may be described in connection with, for example, the case where the characters are shifted to the right by only a 3-dot position, as shown in FIG. 8B. The CPU 10 outputs "XX100011" to the data bus for the 3-bit shift processing and sets the lower six bits thereof in the address register 108. EX="1" due to bit 5, thereby enabling inversion of the bit mask pattern data. $\overline{CS}$="0" due to bit 4, thereby enabling access of the bit mask memory 106. The address "0011" (=3) of bits 3 to 0 is the address of the bit mask pattern data for the 3-bit shift processing. Hence, the bit mask pattern data "00011111" is read from the bit mask memory 106, thereby enabling write of the five memory blocks MB4, . . . , MB0 of bits 4 to 0. The character pattern is written, not one dot at a time, but one raster at a time, i.e., by writing the character patterns read from the ROM for generating character patterns, which is equipped in the CPU one byte (8 dots) at a time.

The writing operation of eight dots, of the second raster RA=1 from the top of A, will be described. As shown in FIG. 9A, the raster pattern involved is one wherein the dots are located at positions of DP=2 and 5. As shown in FIG. 9B, this pattern is rotated by 3 bits for the 3-bit shift processing operation. The pattern shown in FIG. 9C is written into only bits 4 to 0 (DP=3 to 7), due to the bit mask function. Wherein, X is masked and represents the bit which cannot be written. The flip-flop 110 is inverted at the trailing edge of the write enable pulse and the bit mask pattern data is also inverted to be "11100000". The CPU 10 also writes the same character pattern (after rotation) into the next character position on the right side. At this time, as shown in FIG. 9D, only bits 7 to 5 (DP=0 to 2) can be written due to the bit mask function. After writing, the flip-flop 110 is inverted at the trailing edge of the write enable pulse, so that the bit mask pattern data remains as it is. Such operations are sequentially repeated, to write the characters which have been shifted to the right from the predetermined character positions. It is also possible to shift to the left by shifting to the right from the predetermined character positions.

As described above, according to the second embodiment, the bit mask pattern data are pre-stored in the bit mask memory, so that the bit mask pattern data can be easily generated. Furthermore, the bit shift processing operation can be easily performed by writing the character patterns, which have been rotated for bits using the bit mask pattern data and its inverted pattern data for bit shift processing, into two adjacent character positions. In addition, since the bit mask pattern data are inverted by the EX-OR gate circuit, only half the number of required bit mask pattern data may be stored.

The present invention is not limited to the above-described embodiments but various changes and modifications are possible. In the second embodiment, it has been described the case wherein the byte data are horizontally written at one character position. However, the present invention may be applied to cases wherein the byte data is vertically written and one character is written at a plurality of character positions, such as the case wherein Chinese characters are written. It may also be possible to perform the superposition display in the combination of a character and a character, or in the combination of a character and a graphic pattern, using a character generator in place of the bit mask memory.

As described above, according to the present invention, the video RAM is constituted by 1 bit×N addresses and the write mask control is enabled on the bit unit basis, thereby providing a video RAM write control apparatus which can perform a complicated write processing operation at high speed.

What is claimed is:

1. A video RAM write control apparatus which controls writing data delivered by a processing unit, into a video RAM for generating an image on a display with addresses, comprising:

n bits×N words video RAM for storing dot pattern data of n bits, representing a dot pattern of n dots to be displayed at said addresses, said video RAM including n memory cells of 1 bit×N words, each said cell having an enable/disable signal terminal to which an enable/disable signal for permitting/inhibiting data from being written into the cell is input;

storing means, coupled to the video RAM, for storing first bit mask pattern data of n-bits, a least significant bit of which, or consecutive lower bits of which, including the least significant bit, represent data write inhibition, and the remaining bits or bit of which represents data write permission each bit of said first bit mask pattern data corresponding to each said memory cell;

signal delivering means, coupled to said video RAM and said storing means, for delivering said enable/-disable signal to said terminal of each said cell according to said first bit mask pattern data read from said storing means, each bit of which corresponds to the cell;

said processing unit rotating a dot pattern to be delivered to said video RAM by i dots, where i is a positive integer less than (n−1), and reading a bit mask pattern data, having lower i bits designating data write inhibition and remaining upper (n−i) bits designating data write permission, from said storing means;

said signal delivering means delivering data write disabled signals to lower i cells and data write enable signals to upper (n−i) cells according to said bit mask pattern data read from said storing means;

said processing unit delivering said rotated data and address data to said video RAM;

inverting means for inverting said bit mask pattern data read from said storing means after the end of first data writing to said video RAM;

said signal delivering means delivering write enable signals to lower i cells and write disable signals to upper (n−1) cells according to said inverted bit mask pattern data; and said processing means delivering said rotated data and next address data to said video RAM in second data writing.

2. A video RAM write control apparatus according to to claim 1, in which said inverting means is activated by said processing unit.

3. A video RAM write control apparatus according to claim 1, in which said signal delivering means includes n gate circuits, each of which has one input terminal to which an output of each bit of said storing means is supplied, and a second input terminal to which a write enable signal is supplied by said processing means, and in which each of said gate circuits inhibits said write enable signal from being delivered to said enable/disable signal terminal of the corresponding cell when corresponding bit of said bit mask pattern data output from said storing means designates data write inhibition.

4. A video RAM write control apparatus according to claim 1, in which said storing means has a disable signal terminal to which a disable signal for inhibiting said storing means from being accessed is supplied when said processing unit selects a non bit mask data writing operation, and further comprising means for delivering data of which all bits designate data write permission to said signal delivering means.

5. A video RAM write control apparatus according to claim 1, further comprising register means coupled to said storing means and said processing unit for storing address data delivered by said processing unit which is used for accessing said storing means.

6. A video RAM write control apparatus according to claim 5, wherein said register means further stores data supplied by said processing unit for activating said inverting means.

7. A video RAM write control apparatus according to claim 5, wherein said register means further stores data for inhibiting said storing means from being accessed which is supplied to the disable signal terminal of said storing means.

8. A video RAM write control apparatus according to claim 1, in which various kinds of bit mask pattern data are prestored in said storing means by said processing means before said processing unit writes dot pattern data into said video RAM.

9. A video RAM write control apparatus according to claim 1, said storing means comprises a bit mask memory, in which another bit mask pattern data of n bits is set by said processing unit.

10. A video RAM control apparatus according to claim 9, wherein said bit mask memory stores second bit mask pattern data comprising only one bit designating data write permission and remaining bits designating data write inhibition.

11. A video RAM write control apparatus which controls writing data delivered by a processing unit into a video RAM for generating an image on a display with addresses, comprising:

n bits×N words video RAM for storing dot pattern data of n bits representing a dot pattern of n dots to be displayed at said addresses, said video RAM including n memory cells of 1 bit×N words, each said cell having an enable/disable signal terminal to which an enable/disable signal for permitting/inhibiting data from being written into the cell is input;

storing means for storing a plurality of bit mask pattern data each including n bits, each of which designates either data write inhibition or data write permission, each bit of said bit mask pattern data corresponding to each said cell;

said processing unit accessing said storing means and writing said bit mask pattern data into said storing means before said processing unit writes said dot pattern data into said video RAM;

said processing unit reading selected one of said bit mask pattern data from said storing means when said processing unit writes dot pattern data into said video RAM in a bit mask write operation; and signal delivering means coupled to said video RAM and said storing means for delivering an enable signal to said terminal of each said cell when that bit of said bit mask pattern data read from said storing means which corresponds to the cell designates data write permission, and for delivering a disable signal to said terminal when said bit designates data write inhibition.

12. A video RAM write control apparatus according to claim 11, further comprising inverting means for inverting said bit mask pattern data read from said storing means after the end of the first data writing.

13. A video RAM write control apparatus according to claim 12, in which said inverting means is activated by said processing unit.

14. A video RAM write control apparatus according to claim 11, in which said signal delivering means includes n gate circuits, each of which has one input terminal to which an output of each bit of said storing means is supplied, and a second input terminal to which a write enable signal is supplied by said processing means, and in which each of said gate circuit inhibits said write signal from being delivered to said enable/disable signal terminal of the corresponding cell when corresponding bit of said bit mask pattern data output from said storing means designates data write inhibition.

15. A video RAM write control apparatus according to claim 11, in which said storing means has a disable signal terminal to which a disable signal for inhibiting said storing means from being accessed is supplied when said processing unit selects a non bit mask data writing operation, and further comprising means for delivering data of which all bits designate data write permission to said signal delivering means.

* * * * *